US005239232A

United States Patent [19]

Heider et al.

[11] Patent Number: 5,239,232

[45] Date of Patent: Aug. 24, 1993

[54] LIGHT BALANCE COMPENSATED MERCURY VAPOR AND HALOGEN HIGH-PRESSURE DISCHARGE LAMP

[75] Inventors: Juergen Heider; Achim Gosslar, both of Munich; Ulrich Henger, Planegg, all of Fed. Rep. of Germany

[73] Assignee: Patent-Treuhand-Gesellschaft für elektrische Glühlampen mbH, Munich, Fed. Rep. of Germany

[21] Appl. No.: 689,155

[22] Filed: Apr. 22, 1991

[30] Foreign Application Priority Data

Apr. 24, 1990 [DE] Fed. Rep. of Germany ..... 4013039

[51] Int. Cl.[5] ..... H01J 17/20; H01J 61/20

[52] U.S. Cl. ..... 313/639; 313/640; 313/641

[58] Field of Search ..... 313/639, 640, 641

[56] References Cited

U.S. PATENT DOCUMENTS 3,798,487 3/1974 Zollweg et al. .
3,842,307 10/1974 Dobrusskin et al. .
4,171,498 10/1979 Fromm et al. .
4,658,177 4/1987 Gosslar et al. .
4,801,846 1/1989 Kramer et al. ..... 313/640

FOREIGN PATENT DOCUMENTS 0169510 1/1986 European Pat. Off. .
0215524 3/1987 European Pat. Off. .
0342762 11/1989 European Pat. Off. .
3731134 8/1988 Fed. Rep. of Germany .
1370020 10/1974 United Kingdom .

*Primary Examiner*—Donald J. Yusko
*Assistant Examiner*—N. D. Patel
*Attorney, Agent, or Firm*—Frishauf, Holtz, Goodman & Woodward

[57] ABSTRACT

The high-pressure lamp has a fill including a metal halide of two groups, in which the first group is a first rare earth halide of dysprosium, thulium and optionally holmium, and a second group of rare earth halide, namely cerium, neodymium, praseodymium, lanthanum; and an alkali metal halide, such as sodium halide and/or cesium halide, preferably iodide or bromide of sodium and/or cesium. The lamp has a high proportion of light radiation in the red range of the color spectrum to provide substantially improved color rendering indices, particularly in the $Ra_8$ region, thereby providing better color balance, without loss of lifetime.

21 Claims, 3 Drawing Sheets

LIGHT BALANCE COMPENSATED MERCURY VAPOR AND HALOGEN HIGH-PRESSURE DISCHARGE LAMP

Reference to related patents, the disclosures of which are hereby incorporated by reference, assigned to the assignee of the present application:

U.S. Pat. No. 3,842,307, Dobrusskin et al.

U.S. Pat. No. 3,471,498, Fromm et al.

U.S. Pat. No. 4,658,177, Gosslar et al.

Reference to related patent, the disclosure of which is hereby incorporated by reference:

U.S. Pat. No. 3,798,487, Zollweg et al.

Reference to related publications:

British Patent 1,370,020;

European Patent 0 215 524, Meulemans et al;

"TECHNISCH-WISSENSCHAFTLICHE ABHANDLUNGEN DER OSRAM-GESELLSCHAFT" ("Technical-Scientific Publications of the OSRAM Company"), published by Springer, Heidelberg, 1986, No. 11, pages 11-30, A. DOBRUSSKIN et al: "Halogen-Metalldampfanlagen mit Seltenen Erden" ("Halogen Metal Vapor Lamps with Rare Earths") and No. 12, pages 65 through 72, D. C. FROMM, "Elektrodenentwicklung fuer kleine Halogen-Metalldampflampen" ("Development of Electrodes for Small Halogen Metal Vapor Lamps").

FIELD OF THE INVENTION

The present invention relates to high-pressure mercury vapor discharge lamps with a special metal halide composition, and more particularly to small lamps of this type, that is, lamps having a power rating of from between 35 to 400 W, and especially 35, 70 or 150 W. The invention is, however, also applicable to mercury vapor high-pressure discharge lamps of higher power rating.

BACKGROUND

Mercury vapor high-pressure discharge lamps usually include an ionizable fill which, besides a noble gas and mercury, also contains metal halides. Lamps with a special composition, namely halides of rare earths, and alkali metals are particularly suitable for general service illumination and especially where the on-off cycling rate is low. Rather low-powered lamps, that is, between 35–400 W and especially 35, 70 or 150 W, are used frequently in double-ended form, in which two pinch seals are provided between which a discharge vessel is located. An external, outer envelope or bulb may also be used. Single-ended lamps, with a single press seal, are also in use, see for example the referenced U.S. Pat. No. 4,658,177.

High-pressure mercury vapor metal halide lamps are available which provide light of various spectral or color characteristics. Basically, three types of lamps are used:

(1) A warm white color, also known as WDL, which corresponds to a color temperature of about 3100 K. Lamps of this type are particularly suitable for interior illumination and used with rather low power ratings, for example about 70 W.

(2) A neutral white color, also known as NDL, corresponding to a color temperature of, typically, about 4300 K. Lamps of this type are also suitable for interior room illumination, and used frequently with intermediate power ratings, that is, for example 150–400 W.

(3) Daylight-simulating color temperature also known as D, which corresponds to a color temperature of at least 5000 K., and used particularly for outdoor illumination, or for accent illumination, and usually provided with higher power ratings, for example 250 W, and above.

The criteria for suitability of such lamps in the general service field are, first of all, a long lifetime, that is, a lifetime in the order of 6000 hours, together with good color rendition, which is expressed in a high color rendering index or, in other words, a high Ra index. The overall color index $Ra_8$ should, at least, have a value of about 85. Improvement of the individual color rendering indices, for example the color rendering index R9, for rendition of colors in the red spectral region, are of particular importance. It has not been possible heretofore to find a satisfactory compromise between long lifetime and good color rendition of the lamps, especially within the red spectral region. This is particularly true for fills of WDL lamps, that is, which are to emit "warm white" light.

The referenced article "TECHNISCH-WISSENSCHAFTLICHE ABHANDLUNGEN DER OSRAM-GESELLSCHAFT" ("Technical-Scientific Publications of the OSRAM Company"), published by Springer, Heidelberg, 1986, No. 11, pages 11-30, A. DOBRUSSKIN et al: "Halogen-Metalldampfanlagen mit Seltenen Erden" ("Halogen Metal Vapor Lamps with Rare Earths"). describes fills for double-ended metal halide discharge lamps of a power rating between 70 and 250 W for the three above-described light colors. For the D light and NDL, a fill is used which contains mercury and the iodides of dysprosium, holmium, thulium as well as sodium or cesium, respectively, and finally thallium (see also U.S. Pat. No. 3,842,307, Dobrusskin et al, assigned to the assignee of the present application). For WDL, that is "warm white" light, a fill of mercury and iodides or bromides of tin, indium, lithium, sodium and thallium is used, see for example, U.S. Pat. No. 4,171,498, FROMM et al. In a 70 W lamp of a fill suitable for WDL light, no rare earth halides were used, since it has been found that the warm white light (WDL) can be obtained with rare earths, while using aodium and thallium additives, only at wall loadings of the lamp at such a value which would interfere with the lifetime of the lamp by chemical reaction of the fill with the quartz glass, of which the envelope is usually made. Wall loadings which permit the use of rare earth are, for example, over 20 W per $cm^2$.

On the one hand, it is unsatisfactory to use different fills for different light colors; on the other, the color rendition with respect to the red spectral components of the fills is still unsatisfactory. For WDL light, the color rendering index R9 = −90; for NDL, R9 = −30. Further disadvantages of these lamps are a relatively low overall color rendering index for WDL lamps, that is, $Ra_8 = 75$, a relatively low light output of about 68 lm/W, and, particularly in case of WDL lamps and NDL lamps, a high degree of spread or scatter of the color temperature of all the three light colors. A sodium-tin fill has an additional disadvantage in that it may lead to increased corrosion of the electrodes, which must be prevented by special and specific construction of the electrodes themselves, see for example "TECHNISCH-WISSENSCHAFTLICHE ABHANDLUNGEN DER OSRAM-GESELLSCHAFT" ("Technical-Scientific Publications of the OSRAM Company"), published by Springer, Heidelberg, 1986, No. 12, pages 65 through 72, D. C. FROMM, "Elektrodenentwicklung fuer kleine halogen-Metalldampflampen" ("Development of Electrodes for Small Halogen Metal Vapor Lamps").

European specification 0 215 524, Meulemans et al, which references the technical-scientific publication of the OSRAM company, a related organization of the assignee of the present application, proposes a solution by using a ceramic discharge vessel with specific geometric relationships between the discharge vessel and the electrodes. This permits the use of indium or rare earth metal halides besides the known suitable components of sodium and thallium. This is an elegant solution—from a theoretical point of view. In actual practice, however, it has been found unsatisfactory since ceramic materials cause problems and are expensive. Problems arise especially in connection with tightness of the seals through which electrodes pass, as well as the development of meltable or flowable glass or glass solder seals which are resistant to halides, and to current supply leads compatible with maintaining tight seals between the ceramic and the specific glass solder or other glass melt substance which is being used.

British Patent 1,370,020, as well as U.S. Pat. No. 3,798,487, Zollweg et al., describe a discharge lamp with a quartz glass bulb which is designed for optimum light output. It retains a fill which, besides mercury, contains a halide of praseodymium (Pr), neodymium (Nd) or cerium (Ce) in a total quantity of $1.4\times10^{-6}$ to $5.4\times10^{-5}$ mol/cm electrode spacing, as well as cesium (Cs) halide in a quantity of $3.5\times10^{-7}$ to $5.4\times10^{-5}$ mol/cm electrode spacing.

This lamp has an extremely high light output, about 140 lm/W, however has a poor overall color rendering index $Ra_8$, and particularly a very poor red index R9. The cold spot temperatures of only 600° C. point already to the poor color rendering index data. As far as color rendering is concerned, the lamp has a pronounced green hue, due to the cerium radiation, in a wave length range of between 480–580 nm. A lamp of this type, thus, is not suited for general service illumination, in which optimal color rendition is of primary importance and must be considered ahead of light output.

THE INVENTION

It is an object to provide a high pressure discharge lamp which is suitable for general service illumination, and is especially applicable to provide light within a wide range of colors, especially in the warm white color spectrum, that is, has good color balance or, in other words, a high color rendering index also within the red spectral region, while having long life and not requiring ceramics for the discharge vessel and special electrode structures in combination therewith.

Briefly, the lamp has a bulb which can be made of quartz glass and includes a fill which comprises at least one rare earth metal halide of a first group and a second group. The first group of the metal halides is a rare earth metal, namely dysprosium and thulium; the second group of rare earth metals halides is cerium, neodymium, praseodymium and lanthanum; additionally, a halide of alkali metals of sodium or cesium is contained in the fill. The fill, additionally, includes, as well known, a noble gas and mercury.

The fill has the advantage that it does not require ceramic discharge vessels but can be included in a quartz glass bulb or discharge vessel. Further, the fill can be so arranged that it provides neutral white light output, in which, for example, the sodium is completely replaced by cesium. This permits constructing lamps with double-ended discharge vessel, for the first time, with a single-based outer bulb. Single-basing, heretofore, was not possible due to the extreme problems which arise when the fill includes sodium, due to sodium diffusion.

In accordance with an important feature of the invention, thallium, which was previously used for correction of the color locus, can be replaced by the rare earths cerium and/or praseodymium and/or lanthanum and/or neodymium. Thallium, basically, provides a line emission in the green spectral range. As a consequence, if the lamp is operated under low power conditions, the light has a green tint or green hue, since the other substances of the fill, in essence rare earths such as dysprosium, holmium and thulium, have a substantially lower vapor pressure, with respect to thallium, at comparable temperatures. A further consequence of this incompatibility is the high spread or dispersion of color temperature of these lamps. This spread or dispersion within the lamps of a group could be reduced, by the present invention, by more than half. Thallium is highly toxic, which is an additional disadvantage and dictates its removal from lamps. Replacement of this toxic thallium by the rare earths cerium, praseodymium, neodymium or lanthanum has the substantial advantage that they provide multiple line spectra at a vapor pressure which is comparable to that of the other rare earths, dysprosium, holmium and thulium. It appears that the negative influence of thallium on the operating conditions of lamps, particularly their color balance or, rather, color imbalance, has not been sufficiently recognized heretofore. It is not quite clear why this is so. In accordance with the present invention, however, it is possible to use rare earth metal fills also for warm white color lamps and, at the same time, obtain extremely high lifetime of, typically, 6000 hours, while using quartz glass for the discharge vessel bulb.

The present invention is not restricted to discharge vessels made of quartz glass, because it is equally useful with ceramic discharge vessels, where it has the advantage that an overall color rendering index of $Ra_8$ of 95 and a red index of R9 of greater than 80 can be obtained with a cold spot temperature of 1000° to 1100° C.

The combination of halides of the two groups of rare earth metals further provides the possibility to replace the sodium halide, which causes problems, at least in part, by another alkali metal halide, namely cesium halide, also in lamps which have neutral white or warm white light output. This has the advantage that the sodium-rare earth complex of the dysprosium or thulium, which affect undesirably the quartz glass of the bulb, can be influenced towards decreased damage to the quartz glass.

A mol relationship of alkali metal halides to rare earth halides of between about 70:30 to 90:10 is particularly desirable for warm white light color. The alkali metal can, primarily, be sodium. Corresponding values for neutral white or daylight simulating light colors are, preferably, about 18:82 to 55:45 and 10:90 to 50:50, respectively. For neutral white light color, sodium and/or cesium is used as the alkali metal; for daylight simulating light colors, cesium should primarily be used.

Measurements have shown that optimum amplification of vapor pressure by formation of complex halide compounds is obtained by relationships of alkali metal halides to rare earth halides of between 25:75 to 50:50 when light output increase is the sole criterion.

Particularly good results are obtained when using dysprosium alone, or dysprosium and thulium together. These provide a multi-line spectrum with a wide continuous region. Possibly, holmium may be added. Preferably, cerium or neodymium are used alone as the rare earth metals of the second group for color correction, since the chromaticity loci thereof are farthest above the Planckian distribution. Preferably, the proportion with respect to overall metal halides, when using cerium halide, should be between 2–17 mol-%.

The halogen used, Preferably, is iodine, since it provides high vapor pressure and the resulting fill will not be very aggressive. Bromium may also be used.

Further additives for the fill which are particularly suitable are the well known mercury iodide, $HgJ_2$ and/or mercury bromide, $HgBr_2$.

DRAWINGS

FIG. 1 is a side view of a double-ended, double-based high-pressure discharge lamp having a double-ended discharge vessel located therein;

FIG. 2 illustrates the spectral distribution of radiated flux of a 70 W lamp having the fill in accordance with the present invention, in full line, and an identical lamp, having a fill of the prior art, in broken line, the curves being drawn standardized to luminous flux of 1 kilo lumen (1000 lumens - klm), and FIG. 3 is a front view of a single-based high-pressure discharge lamp enclosing a double-ended, pinch-sealed discharge vessel.

DETAILED DESCRIPTION

Figure 1:
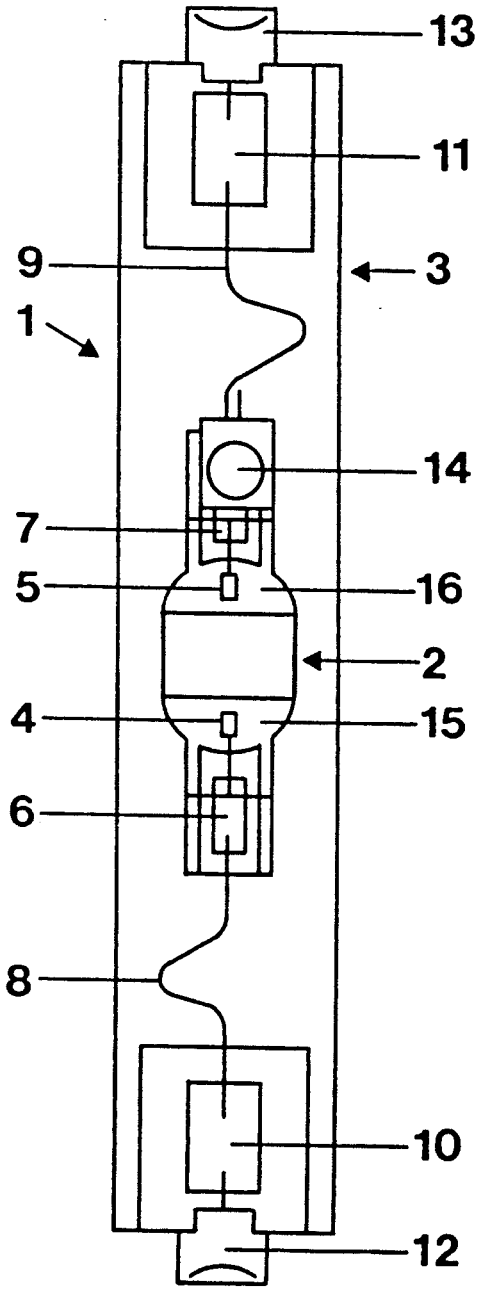

FIG. 1 illustrates highly schematically a 70 W high-pressure discharge lamp 1 which has inside of the double-ended outer envelope 3 a discharge vessel 2 made of quartz glass, which is pinch-sealed at two opposite ends. The electrodes 4, 5, shown only schematically, are electrically connected by foils 6, 7 in the pinch seals, and connected to external current supply leads 8, 9 which, in turn, are connected to foils 10, 11, pinch-sealed in the outer envelope 3 to be connected to further terminals 12, 13 formed in a base, for example ceramic base of the type R7s. An additional wire element is included in one of the pinch seals of the discharge vessel 2 which supports a small metal plate having getter material 14 thereon. This wire is not connected to any current supply lead and thus is voltage-free. The ends 15, 16 of the discharge vessel 2 are, preferably, covered with a heat reflecting coating, so that the cold spot temperature of the lamp is above 870° C.

The discharge vessel 2 retains a fill. The lamp is designed for warm white light, that is, WDL, having a color temperature of about 3100 K.

Fill Example 1

Color temperature 3100 K.

fill: 12 mg mercury argon overall: 27 μmol of the following metal halides, in which the molecular proportion is given in percent of the overall metal halides:

3% $DyJ_3$, 15% $TmJ_3$, 5% $CeJ_3$, 77% NaJ.

The metal halides correspond to a specific proportion of metal halides of 3.9 μmol/mm arc length, and a specific arc power of 10.7 W/mm.

Volume of discharge vessel: 0.7 $cm^3$.

electrode spacing: 7 mm.

wall loading: 19 $W/cm^2$.

light output: 72 lm/W; overall light output: 5400 lumens.

color rendering index $Ra_8$: 85.

color rendering index R9: +15.

spread of color temperature: ±100 K.

lifetime: 6000 hours.

For comparison, a lamp otherwise identical to that of Example 1, but having a fill of the prior art containing the halides of sodium, tin, thallium, indium and lithium, has 8% less light output and the specific light output is 7.5% less, namely 67 lm/W. Color rendering index $Ra_8$ was 76, and the index R9 was −90. The spread of color temperature was ±300 K.

Figure 2:
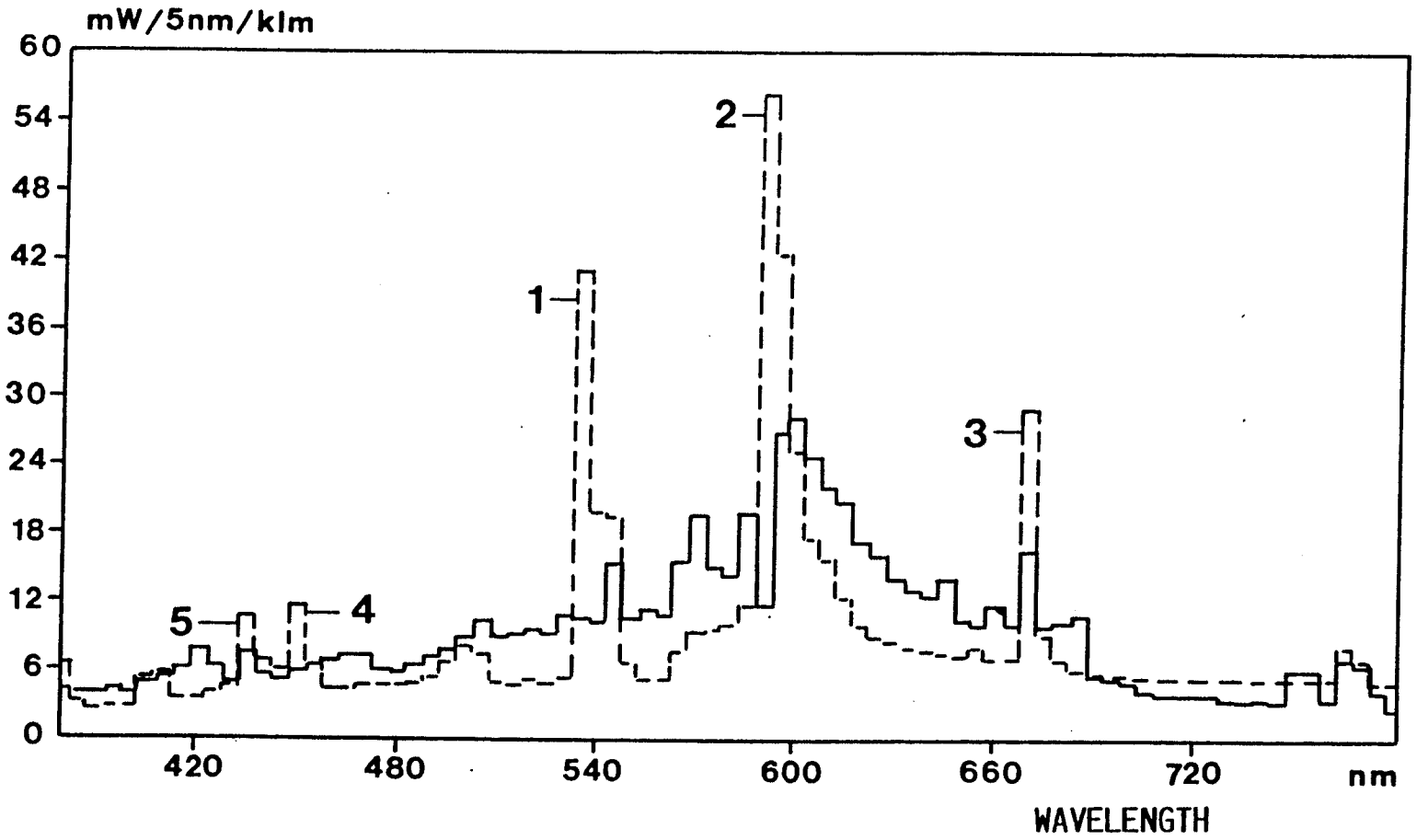

FIG. 2 illustrates in a comparison graph the spectral distribution, given in milliwatt per kilolumen within a step width of 5 nanometers, of a 70 W lamp having the known sodium-tin fill in broken line and the sodium-rare earth fill in accordance with the present invention; the spectral distribution is shown for the lamp of the present invention in full line. What is striking is the much more uniform distribution of light so that the overall uniformity of the spectral distribution thereof is improved markedly. Pronounced single lines, derived specifically from thallium (1), sodium (2), lithium (3), indium (4) and mercury (5) (FIG. 2) are eliminated or highly attenuated. The proportion of radiation in the red color spectrum is substantially increased, by about 50%, which, of course, is reflected in the improved color rendering index. As a result, all saturated colors appear much more natural. This is of particular interest when the lamp is used for interior illumination, for example for illumination of foods in stores and supermarkets, and for display, for example display window illumination.

Example 2

A lamp similar to that of FIG. 1, but rated for 150 W for neutral white light color (NDL), has the following fill:

mercury argon overall: 14.5 μmol of the following metal halides, in which the molar proportion is given in percent of the overall metal halides:

32% $DyJ_3$, 24% $TmJ_3$, 10% $CeJ_3$ and 34% NaJ. Specific proportion of metal halides with respect to arc length: 1.5 μmol/mm; specific arc power: 15 W/mm.

color temperature: 4300 K.

light flux: 12,500 lm.

volume of discharge vessel: 2.6 $cm^3$.

specific available light: 85 lm/W.

color rendering index $R_{a8}$: 92; R9: +50.

electrode spacing: 18.0 mm.

wall loading: 16 $W/cm^2$.

color spread: ±100 K.

lifetime: 6000 hours.

For comparison, an otherwise identical lamp but having a fill comprising metal halides composed of iodides of dysprosium, holmium, thulium, sodium and thallium, had a specific light output of 75 lm/W, a color rendering index $R_{a8}$ of 85, and R9 for red content of −30. Spread of color temperature ±300 K.

Example 3

A lamp similar to that described in connection with FIG. 1, but having 400 W power and providing light similar to daylight, that is, a D lamp, has the following fill and characteristics:

mercury and argon;

overall: 37 μmol of the following metal halides, in which the molecular proportion is given in percent of the overall metal halides:

40% $DyJ_3$, 23% $TmJ_3$, 13% $CeJ_3$ and 24% CsJ.

Specific proportion of metal halides: 1.15 μmol/mm arc length;

specific arc power: 12.5 W/mm;

color temperature: 5600 K.

light output: 90 lm/W.

color rendering index: $R_{a8}$: 91; red index R9:+60.

spread of color temperature: ±250 K.

For comparison, an otherwise identical lamp and having a fill in which the metal halides are iodides of dysprosium, holmium, thulium, sodium and thallium had a specific light output of 75 lm/W, a red color rendering index R9 of +30, and a color temperature spread of ±500 K.

Figure 3:
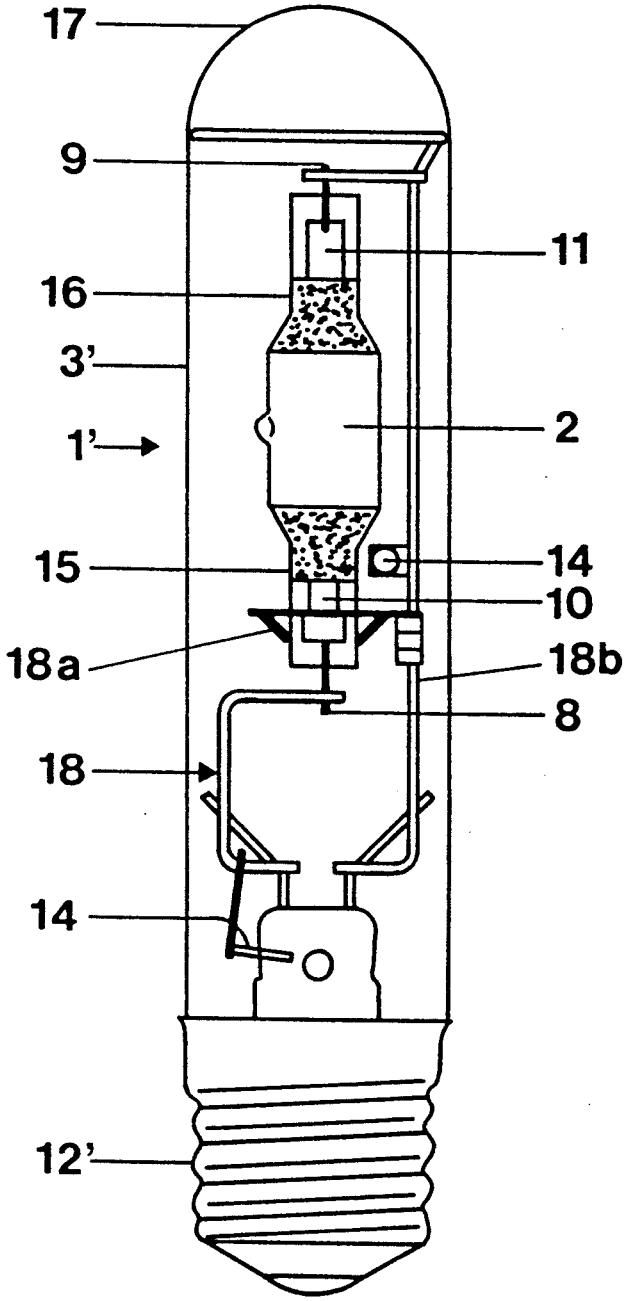

FIG. 3 illustrates another embodiment of a 400 W lamp 1', having neutral white light (NDL) output. In contrast to the embodiment of FIG. 1, the outer surrounding bulb 3' is single-ended, that is, has a screw-in base 12' at only one end. The discharge vessel 2 is double-ended, that is, has two pinch seals. The bulb 3' can be cylindrical or bulged or barrel or ellipsoid shaped, and is made of hard glass. One end of the outer bulb has a rounded cap 17, the other end is formed with a standard screw-in base 12'. A holding frame 18 secures the discharge vessel 2 axially within the interior of the outer bulb 3'. The holder frame 18 is made, as well known, of a holder structure and two current supply leads, one of which is connected to the lead 8 from the pinch seal of the discharge vessel 2, whereas the other is connected via a massive metal support rod extending along the side wall of the discharge vessel 2 towards the other current supply lead 9. A support and holding element **18*a*, made of sheet metal, and secured to the rising frame member 18*b*, for example by welding, holds the discharge vessel 2 in position. The rising frame member 18*b*, in the region of the cap 17**, is formed in a part circle.

The discharge vessel 2 has heat retention or heat damming coatings 15, 16 located adjacent the ends thereof. A getter 14 is secured to the frame 18, for example by being attached to the rising element **18*b***.

Example 4

The fill within the discharge vessel 2 of FIG. 3 has mercury and argon and 37 μmol of the following metal halides, in which the molecular proportion is given in percent of overall metal halide components:

42% $DyJ_3$, 24% $TmJ_3$, 14% $CeJ_3$ and 20% CsJ.

Specific metal halide content: 1.25 μmol/mm.

specific arc power: 13 W/mm.

A lamp similar to the lamp 1 (FIG. 1), having the same vessel volume and 70 W power, suitable for warm white light (WDL) may have one of the fills of examples 5 to 7:

Example 5

12 mg mercury.

3.6 mg NaJ.

2.6 mg $TmJ_3$.

0.8 mg $CeJ_3$.

Relationship of alkali metal halide to rare earth metal halide: 79:21.

Color temperature: about 3300 K.

Example 6

A 70 W lamp as in Example 5, for warm white light output, in which, instead of cerium, neodymium is used.

Fill: 3.6 mg NaJ, 2.0 mg $TmJ_3$ and 1.4 $NdJ_3$.

Relationship of alkali metal halide to rare earth metal halide: 79:21.

Color temperature: about 3600 K.

Example 7

A lamp similar to the lamp of Example 6, having a fill of 2.9 mg NaJ, 0.4 mg $DyJ_3$ and 2.7 mg $TmJ_3$ and 0.7 mg$NdJ_3$.

Color temperature: 3450 K.

The quantity of neodymium iodide is reduced with respect to that of Example 6, thulium iodide is increased, and dysprosium iodide is added—with respect to Example 6.

We claim:

1. Long-life, general service high-pressure mercury vapor discharge lamp having a discharge vessel;

electrodes (4, 5) extending into the discharge vessel and electrically connected to externally extending current supply leads (8, 9); and a fill in said discharge vessel, said fill including a noble gas, mercury, and said fill further consisting essentially of fill components which, in operation of the lamp, provide a rated light output of more than 67 lumens per watt, a rated life-time of the lamp in the order of about 6,000 hours, and at a wall loading in which the fill does not effectively react chemically with the discharge vessel and thereby does not decrease said rated lifetime of the lamp, wherein said fill components comprise an alkali metal halide, wherein the alkali metal is sodium or cesium, and devoid of calcium; and two groups of rare-earth metal halides which are devoid of thallium, wherein a first group of the rare-earth metal halide comprises at least one halide of dysprosium and thulium, and wherein the second group of the rare earth metal halide comprises a halide of cerium, neodymium, praseodymium, and lanthanum.

2. The lamp of claim 1, said lamp, when energized, providing light of essentially warm-white (WDL) color, and wherein the molecular relationship of alkali metal halide and all of said rare earth metal halides is between about 70:30 and 90:10, and said alkali metal is primarily sodium.

3. The lamp of claim 2, wherein the light output is at least 72 lm/W.

4. The lamp of claim 1, providing light of essentially neutral white color (NDL) when energized, and wherein the molecular relationship of the alkali metal halides and all of said rare earth metal halides is between about 18:82 to 55:45;

and wherein said alkali metal halide is a sodium halide, a cesium halide, or a mixture of sodium halide and cesium halide.

5. The lamp of claim 4, wherein said alkali metal halide is cesium halide.

6. The lamp of claim 4, wherein said discharge vessel is a double-ended, pinch-sealed discharge vessel (2);

a single-ended outer bulb (3, 3') surrounding said discharge vessel; and wherein said alkali metal halide is a cesium halide.

7. The lamp of claim 4, wherein the light output is at least 72 lm/W.

8. The lamp of claim 1, providing light of essentially daylight color (D), when energized, and wherein the molecular relationship of the alkali metal halide and all of said rare earth metal halides is between about 10:90 to 50:50.

9. The lamp of claim 8, wherein the light output is at least 72 lm/W.

10. The lamp of claim 1, wherein the second group of rare earth metal halide comprises a halide of cerium, neodymium, or a mixture of cerium halide and neodymium halide.

11. The lamp of claim 10, wherein the proportion of cerium halide to the overall metal halide content of both said group is between 2 and 17 mol percent.

12. The lamp of claim 1, wherein the rare earth metal halide of the first group comprises dysprosium halide and thulium halide.

13. The lamp of claim 1, wherein the halide is primarily iodide.

14. The lamp of claim 1, wherein the fill components further comprise mercury iodide ($HgJ_2$), mercury bromide ($HgBr_2$) or mercury iodide and mercury bromide.

15. The lamp of claim 1, wherein said first group of rare earth metal halides further includes a holmium halide.

16. The lamp of claim 1, wherein the light output is at least 72 lm/W.

17. The lamp of claim 1, wherein said wall loading is under 20 W/cm$^2$.

18. Long-life, general service high-pressure mercury vapor discharge lamp having a discharge vessel;

electrodes (4, 5) extending into the discharge vessel and electrically connected to externally extending current supply leads (8, 9); and a fill in said discharge vessel, said fill including a noble gas, mercury, and said fill further consisting essentially of fill components which, in operation of the lamp, provide a rated light output of more than 67 lumens per watt, a rated life-time of the lamp in the order of about 6,000 hours, and at a wall loading in which the fill does not effectively react chemically with the discharge vessel and thereby does not decrease said rated lifetime of the lamp, wherein said fill components comprises at least one rare-earth metal halide of a first group, which is devoid of thallium halide, wherein said first group of the rare-earth metal halide is a halide of dysprosium and thullium, and at least one rare-earth metal halide of a second group, which is devoid of thallium halide, wherein the rare-earth metal of the second group is cerium, neodymium, praseodymium, lanthanum, and an alkali metal halide, said alkali metal halide being devoid of calcium and comprising sodium halide, cesium halide or sodium and cesium halide.

19. The lamp of claim 18, wherein said first group is a halide of dysprosium, thulium and holmium.

20. The lamp of claim 18, wherein said first group is a halide of dysprosium and thulium.

21. The lamp of claim 18, wherein said wall loading is under 20 W/cm$^2$.

* * * * *